US005197606A

United States Patent [19]

Lancaster

[11] Patent Number: 5,197,606

[45] Date of Patent: Mar. 30, 1993

[54] CUSHION MEMBER FOR USE IN A SHIPPING CONTAINER

[76] Inventor: Gary D. Lancaster, 950 W. Marietta St., N.W., Atlanta, Ga. 30318

[21] Appl. No.: 907,073

[22] Filed: Jul. 1, 1992

[51] Int. Cl.[5] ..... B65D 81/02

[52] U.S. Cl. ..... 206/594; 206/486; 206/588; 206/589; 206/591

[58] Field of Search ..... 206/320, 326, 477, 482, 206/483, 486, 487, 585, 586, 588, 589, 590, 591, 592, 594

[56] References Cited

U.S. PATENT DOCUMENTS

| | | | |
|---|---|---|---|
| 2,160,816 | 6/1939 | Barnes | 206/586 |
| 2,410,591 | 11/1946 | Turner | 206/591 |
| 2,620,062 | 12/1952 | Schuler | 206/320 |
| 2,894,672 | 7/1959 | Bamberg | 206/585 |
| 3,015,428 | 1/1962 | Magazzu | 206/592 |
| 3,123,274 | 3/1964 | Burke | 206/592 |
| 3,182,885 | 5/1965 | Maio | 206/592 |
| 3,497,057 | 2/1970 | Traner et al. | 206/585 |
| 3,532,263 | 10/1970 | Ross | 206/585 |
| 3,921,890 | 11/1975 | Reihm | 206/592 |
| 3,971,472 | 7/1976 | Veenman | 206/590 |
| 4,008,804 | 2/1977 | Poggiali | 206/320 |
| 4,019,672 | 4/1977 | Giannini | 206/592 |
| 4,170,297 | 10/1979 | Johnson | 206/588 |
| 4,294,358 | 10/1981 | Nauheimer et al. | 206/589 |
| 4,469,224 | 9/1984 | Ritter | 206/591 |
| 4,498,580 | 2/1985 | Getz et al. | 206/592 |

*Primary Examiner*—David T. Fidei
*Attorney, Agent, or Firm*—Tsugihiko Suzuki

[57] ABSTRACT

A cushioning member comprises top and bottom spaced parallel panels and a pair of spaced parallel side panels foldably joined to the bottom panel along fold lines. The top panel includes a pair of panel portions foldably joined respectively to the side panels along fold lines. The panel portions overlap each other and are secured together in a flat face contacting relation. Teh fold lines are parallel to one another, and thereby the cushioning member may be collapsed along the fold lines. A retaining flap is provided to hold the cushioning member in a squared, set-up condition.

11 Claims, 6 Drawing Sheets

CUSHION MEMBER FOR USE IN A SHIPPING CONTAINER

BACKGROUND OF THE INVENTION

The present invention relates to a cushion or pad for placement in a shipping container, and more particularly to a collapsible cushion formed preferably of corrugated board, which can be set up easily from a flat collapsed condition.

One cushion known in the art is a skid type cushion designed to be laid underneath an article in a shipping container. This cushion comprises a bottom panel and two tubular structures disposed side by side on the bottom panel. The tubular structures are locked in their positions on the bottom panel by lock tabs struck from the bottom panel. The tubular structures also are interconnected and reinforced by end flaps. This cushion is formed from a rectangular blank of corrugated board having its opposite end margins folded along parallel fold lines into the two tubular structures respectively.

The cushion mentioned above must be fully assembled directly from a blank before it is placed in a shipping container. This assembling process, the two tube-forming process in particular, is laborious and inefficient. A good deal of material is required to form the two tubular structures. Furthermore, this cushion is extremely difficult to fold flat without full disassembly into a blank form.

What is needed, therefore, is an improved cushion for use in a shipping container. Such a cushion should be easy to set up and require less material. Such a cushion should also be easy to fold flat.

SUMMARY OF THE INVENTION

The present invention provides a cushion of a collapsible tubular construction. Such a cushion comprises top and bottom panels disposed in a spaced parallel relation to each other and a pair of spaced parallel side panels foldably joined to the bottom panel along first fold lines. The top panel includes a pair of panel portions foldably joined respectively to the side panels along second fold lines. The panel portions overlap each other and are secured together in a flat face contacting relation. The first and second fold lines are parallel to one another, and thereby the cushion can be collapsed flat along the first and second fold lines. Retaining means is provided to hold the cushion in a squared, set-up condition.

This cushion may be supplied in a collapsed condition, i.e., in the form of a flat collapsed tube, and may be set up from the collapsed condition at a place of packing, i.e., a place where the cushion is positioned into a shipping container. Setting up of this cushion can be achieved simply by erecting the side panels and by operating the retaining means. Besides, this cushion eliminates the use of two tubular structures on a bottom panel and thus requires less material than those conventional cushions.

In one preferred embodiment, the retaining means is a flap struck from the bottom panel and foldably joined to the bottom panel along a crease line. The retaining flap functions to hold the cushion in a set up condition when it is folded into the cushion to extend between the side panels. The retaining flap may have a locking tab disposed at the free edge thereof. This locking tab may be received in a slot formed in the top panel when the retaining flap is in a folded position; in cooperation with the slot, the tab locks the retaining flap in a folded position.

In one preferred embodiment, the cushion has keel means which comprises a center panel and a glue flap. The center panel is foldably joined to the free edge of one of the panel portions and extends parallel to the side panels toward the bottom panel. The glue flap is foldably joined to the center panel along a fold line parallel to the first and second fold lines and is secured to the bottom panel. The keel means intersects the retaining flap and have at the intersection a cutout for permitting the retaining flap to pivot about the crease line.

Another aspect of the present invention is directed to a cushion formed from a blank of a generally rectangular configuration. The blank includes a bottom panel, a pair of side panels foldably joined to the bottom panel, and a pair of top panel portions foldably joined respectively to the side panels. The panel portions overlap each other and are secured together in a flat face contacting relation to form the blank into a tubular structure. The cushion is provided with retaining means for holding the tubular structure in a squared, set-up condition.

Accordingly, it is an object of the present invention to provide a cushion which is formed from a blank and which is easy to assemble.

Another object of the present invention is to provide a corrugated board cushion which minimizes corrugated board requirement.

A further object of the present invention is to provide a collapsible cushion which can be folded flat and can be set up easily from a flat collapsed condition.

Other objects and advantages of the present invention will be apparent from the following description, accompanying drawings and the appended claims.

DETAILED DESCRIPTION OF THE PREFERRED EMBODIMENT

Figure 1:
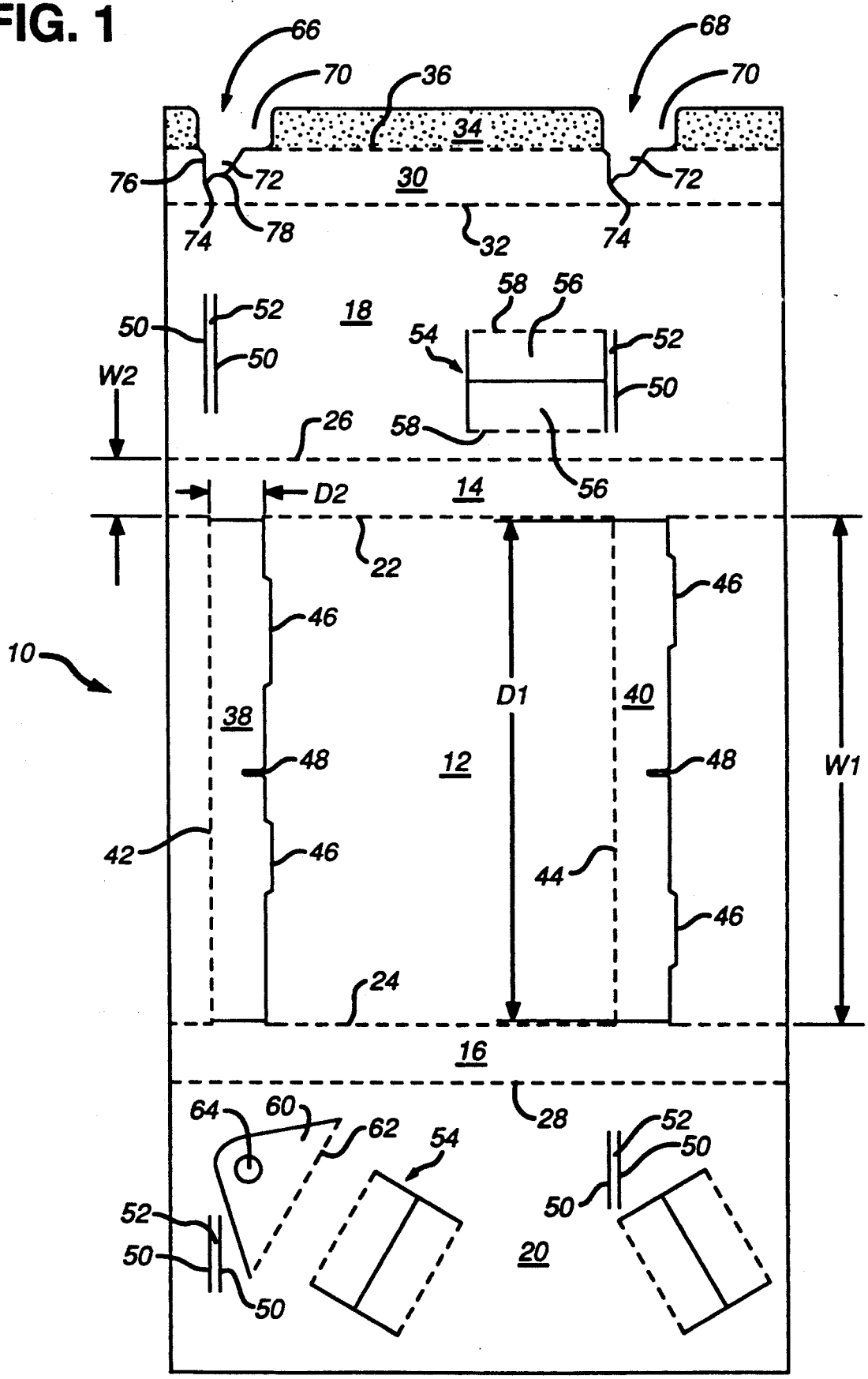
FIG. 1 is a plan view of a blank from which a cushion according to the present invention is formed.

A cushion according to the present invention is illustrated in blank form in FIG. 1 wherein reference numeral 10 designates a generally rectangular blank for forming a cushion/pad to be laid underneath a water heater. The blank 10 is formed of corrugated board and includes five main panels joined in series in a row. More particularly, the blank 10 has a rectangular bottom panel 12, a pair of slat-like side panels 14 and 16 and a pair of rectangular top panel portions 18 and 20. The side panels 14 and 16 are foldably joined respectively to the opposite side edges of the bottom panel 12 along fold lines 22 and 24. The side panels extend away from the bottom panel 12 to outer edges 26 and 28, and the panel portions 18 and 20 are foldably joined respectively to the outer edges of the side panels 14 and 16 along fold lines 26 and 28.

Beside the five main panels, a center panel 30 is foldably joined to the free side edge of the panel portion 18 along a fold line 32. A glue flap 34 is further foldably joined along a fold line 36 to the side edge of the center panel 30 opposite the fold line 32.

The fold lines 22, 24, 26, 28, 32 and 36 are parallel to one another. The side panels 14 and 16 are of the same shape and size, whereas the center panel 30 is equal in length and width to the side panels 14 and 16.

The bottom panel 12 has two retaining flaps 38 and 40 struck respectively from the portions near the opposite end edges thereof. These retaining flaps 38 and 40 are foldably joined to the bottom panel 12 along crease lines 42 and 44 extending across the width (W1) of the bottom panel 12 between the fold lines 22 and 24. Stated differently, each retaining flap has a longitudinal dimension (D1) generally equal to the width (W1) of the bottom panel 12. The lateral dimension (D2) of each retaining flap is generally equal to the width (W2) of the side panels 14 and 16. Locking tabs 46 are provided at the free edge of each retaining flap whereas a notch 48 is formed in that portion of each retaining flap between the locking tabs 46.

Each of the panel portions 18 and 20 has two pairs of parallel straight cut lines 50 extending along the width of the panel portion. Each pair of the cut lines 50 define a strip 52 slightly displaceable in a direction perpendicular to the associated panel portion. When displaced, these strips 52 respectively define slots which cooperate with the locking tabs 46, which will be described later in more detail.

The panel portion 18 has a H-shaped cut 54 whereas the panel portion 20 has two H-shaped cuts 54. Each H-shaped cut 54 defines a pair of opposed bend flaps 56 which are foldable about fold lines 58. These bend flaps 56, when folded inwardly, define an opening. These opening are designed to receive the legs of a water heater. In the panel portion 18, one of the parallel cut lines 50 serves at the same time as a part of the H-shaped cut 54. A substantially triangular tab 60 is struck from the panel portion 20. This tab 60 is foldably joined along a fold line 62 to the panel portion 20 and has an aperture 64 for receiving a pipe portion, such as a drain pipe and supply pipe, of the water heater.

The center panel 30 and the glue flap 34 together as a single keel portion is provided with two cutouts 66 and 68. The cutout 66 is formed at a distance from the adjacent one of the opposite end edges of the keel portion. This distance is generally equal to the distance between the retaining flap 38 and the adjacent end edge of the bottom panel 12. Likewise, the distance between the cutout 68 and the adjacent end edge of the keel portion is generally equal to the distance between the retaining flap 40 and the adjacent end edge of the bottom panel 12. Each cutout consists of a larger portion 70 and smaller portion 72. The larger portion 70 opens to the free side edge of the glue flap 34 and extends all the way across the width of the glue flap 34. The smaller portion 72 extends into the center panel 30 and terminates at a tip end 74 from which a straight edge 76 and an arcuate edge 78 extend toward the larger portion 70 to define the smaller portion 72.

Figure 2:
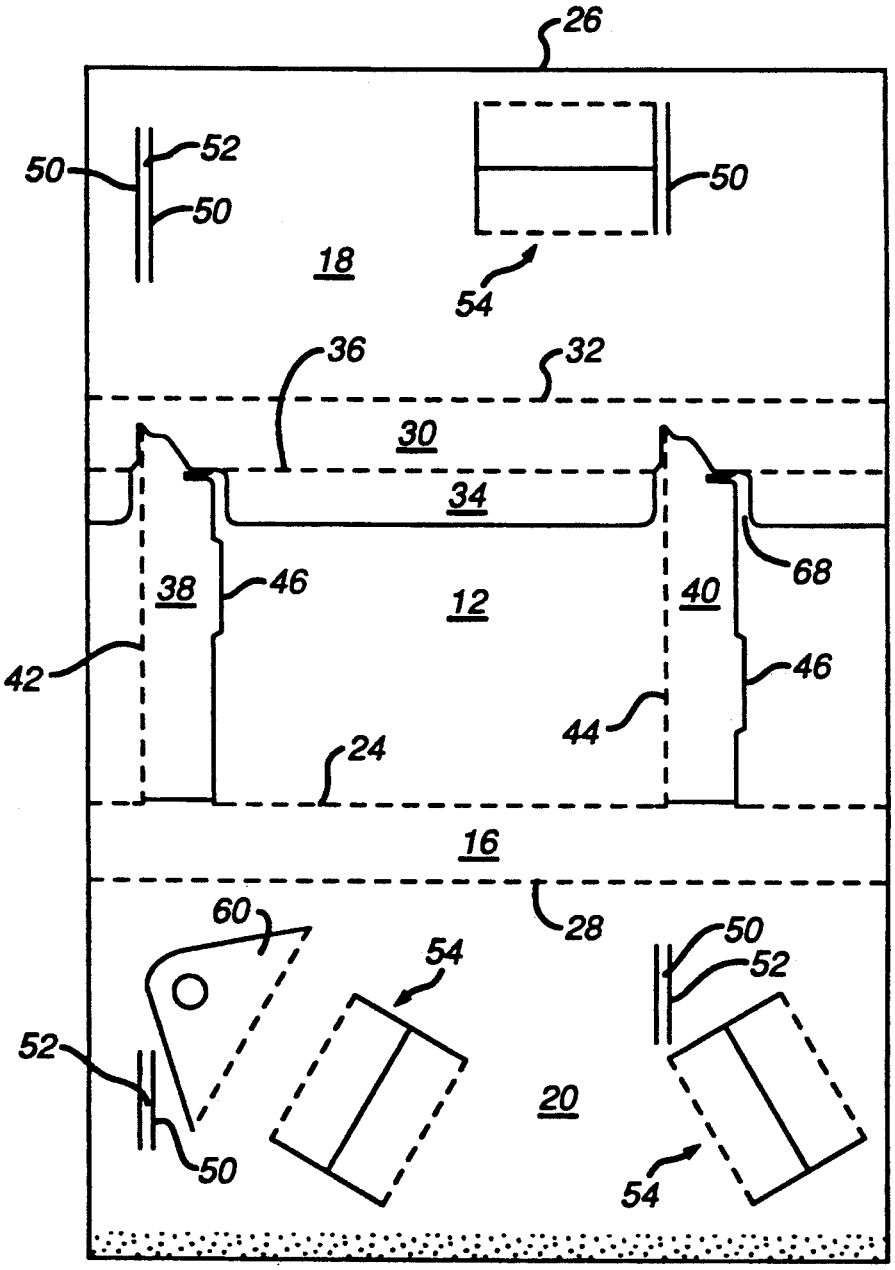
FIGS. 2 and 3 are plan views depicting intermediate stages through which the blank of FIG. 1 is manipulated and glued in order to form a completed cushion of the present invention.
Figure 3:
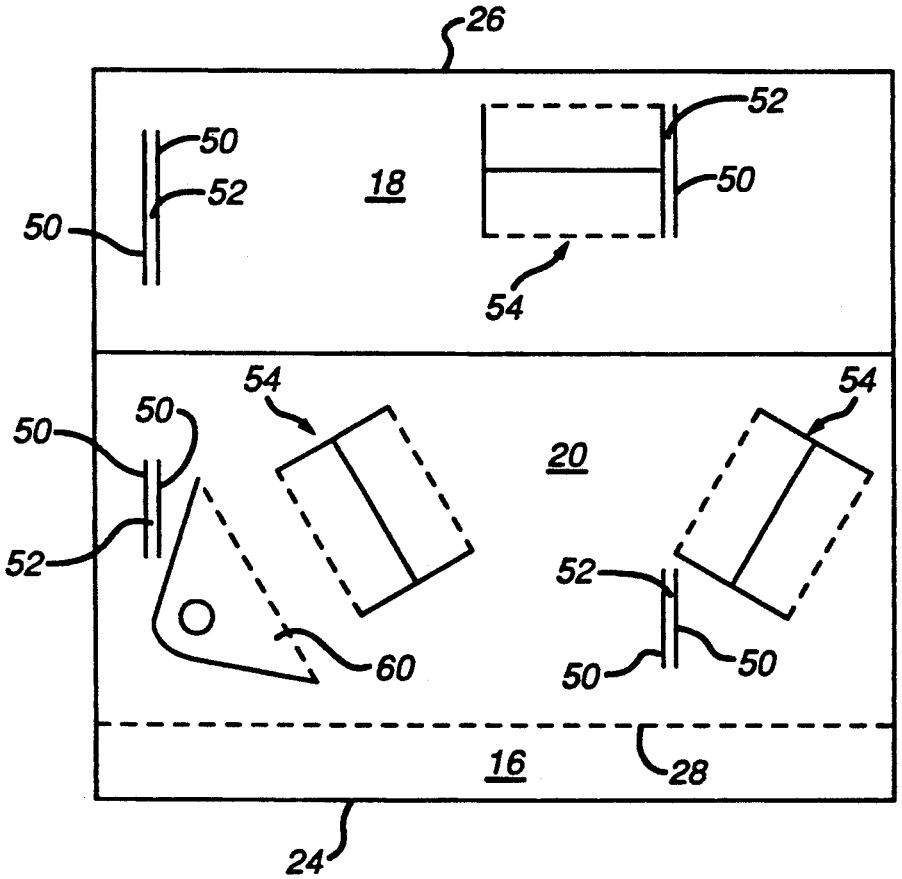

The blank 10 described above is preformed, preferably at the place where the blank is manufactured, into a flat collapsed tubular structure. To preform a flat structure from the blank 10, the following steps are taken. First, glue is applied to the glue flap 34 as shown by the stippling in FIG. 1. Then the panel portion 18, the center panel 30 and the glue flap 34 are folded along the fold line 26 into a position over the bottom and side panels 12 and 14 as shown in FIG. 2. By this means, the glue flap 34 is adhered to the bottom panel 12. The cutouts 66 and 68 are positioned respectively over the retaining flaps 38 and 40 as shown in FIG. 2. Subsequently, application of glue is made to the panel portion 20 along the free edge thereof as shown by the stippling in FIG. 2. Then, the panel portion 20 and the side panel 16 are folded along the fold line 24 into a position over the panel portion 18 as shown in FIG. 3. By this means, the areas of the panel portions 18 and 20 overlapped with each other are adhered to each other in a flat face contacting relation, and the panel portions 18 and 20 form in cooperation with each other a top panel having a width equal to the width (W1) of the bottom panel 12. This results in a cushion in a flat collapsed condition.

Figure 4:
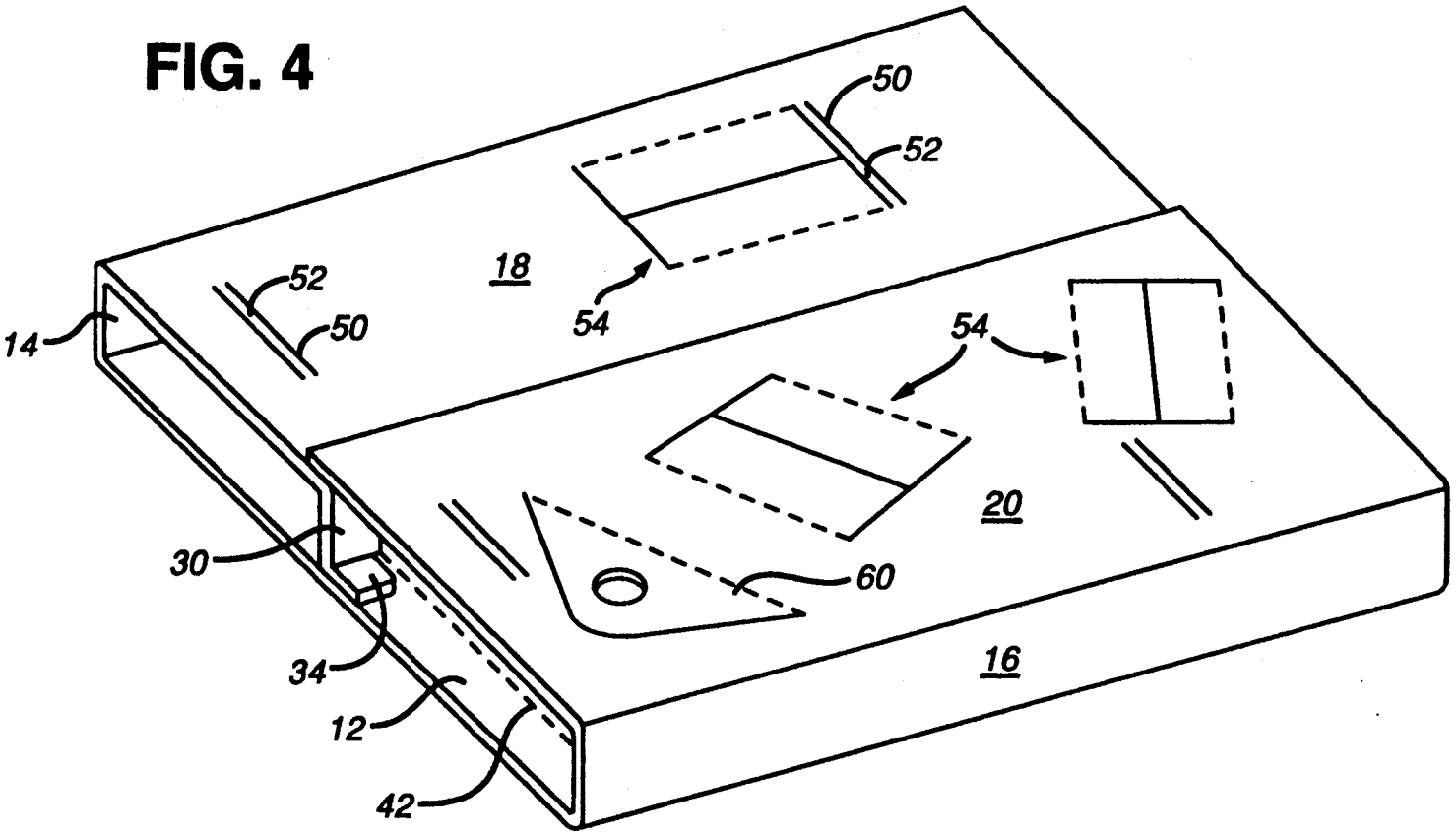
FIG. 4 is a perspective view of a cushion according to the present invention.

The flat structure thus preformed is assembled into a three dimensional cushion at a packing place where a water heater is packed in a shipping container, and it is placed in the container at the position underneath the water heater. Assembly of the cushion is accomplished by erecting the side panels 14 and 16 so that they are disposed at right angle with respect to the bottom panel 12. By this means, the top panel 18 is naturally moved to a position where it is opposed to the bottom panel 12 in a parallel relation, and at the same time the center panel 30 is also naturally erected upright with respect to the bottom panel 12. This forms the flat structure into a substantially tubular cushion as shown in FIG. 4.

Figure 5:
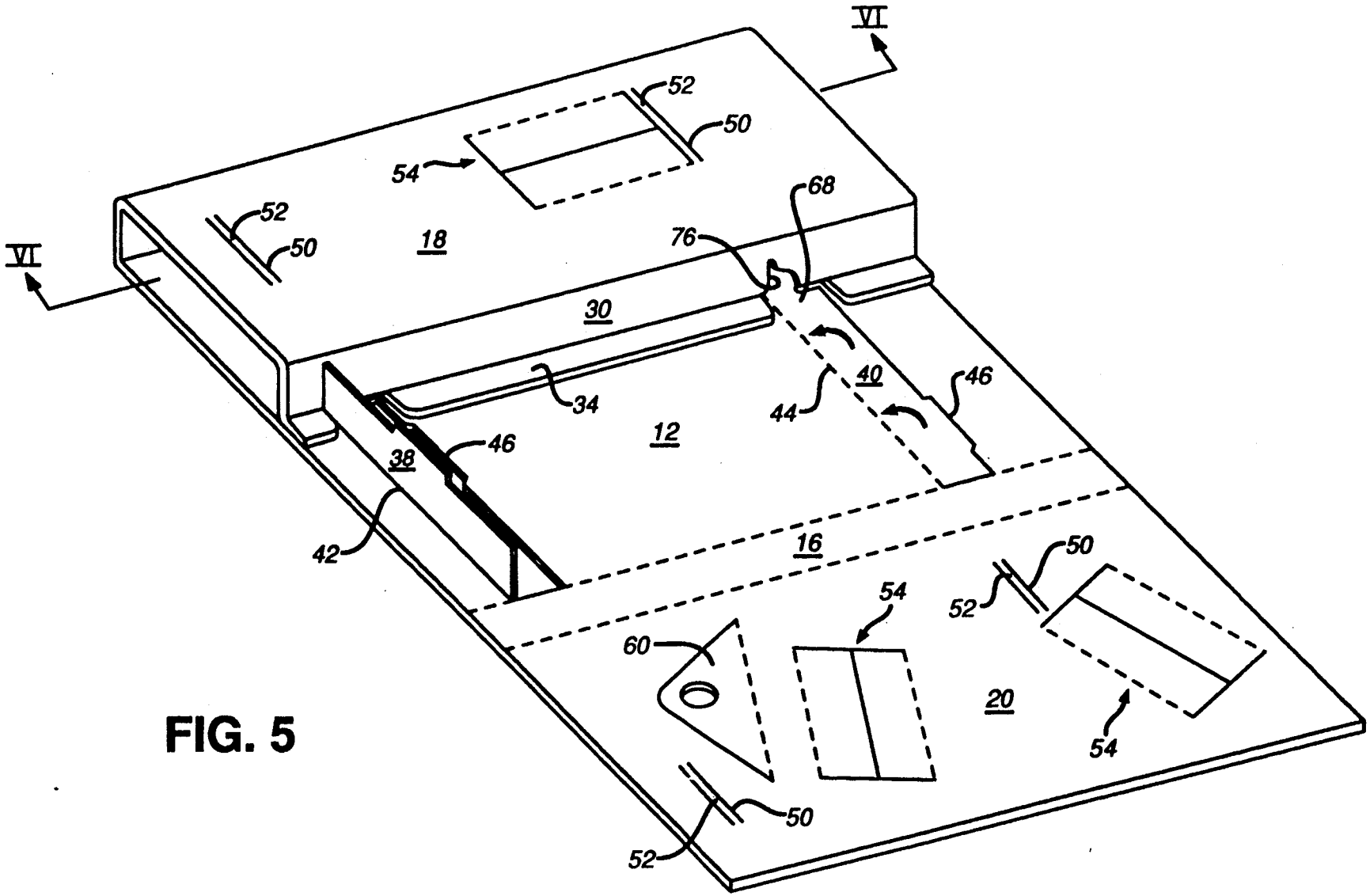
FIG. 5 is a perspective view of the cushion partly deployed to show retaining flaps.

After that, the retaining flaps 38 and 40 are pressed inwardly of the cushion and folded into the same. This is best illustrated in FIG. 5. When pressed, the flap 40 is pivoted about the crease line 44 in the direction indicated by the arrows in FIG. 5. The flap 40 passes through the larger portion 70 of the cutout 68, moves into the smaller portion 72, and finally abuts against the straight edge 76 of the smaller portion 72 to stand upright with respect to the bottom panel 12 like the flap 38 does in FIG. 5. The flap 38, in FIG. 5, is shown fully folded into an upright position where it extends all the way across the width of the cushion between the side panels 14 and 16. Both the flaps 38 and 40, when brought into their respective upright positions, hold the cushion in a squared, substantially tubular set-up condition as shown in FIG. 4.

Figure 6:
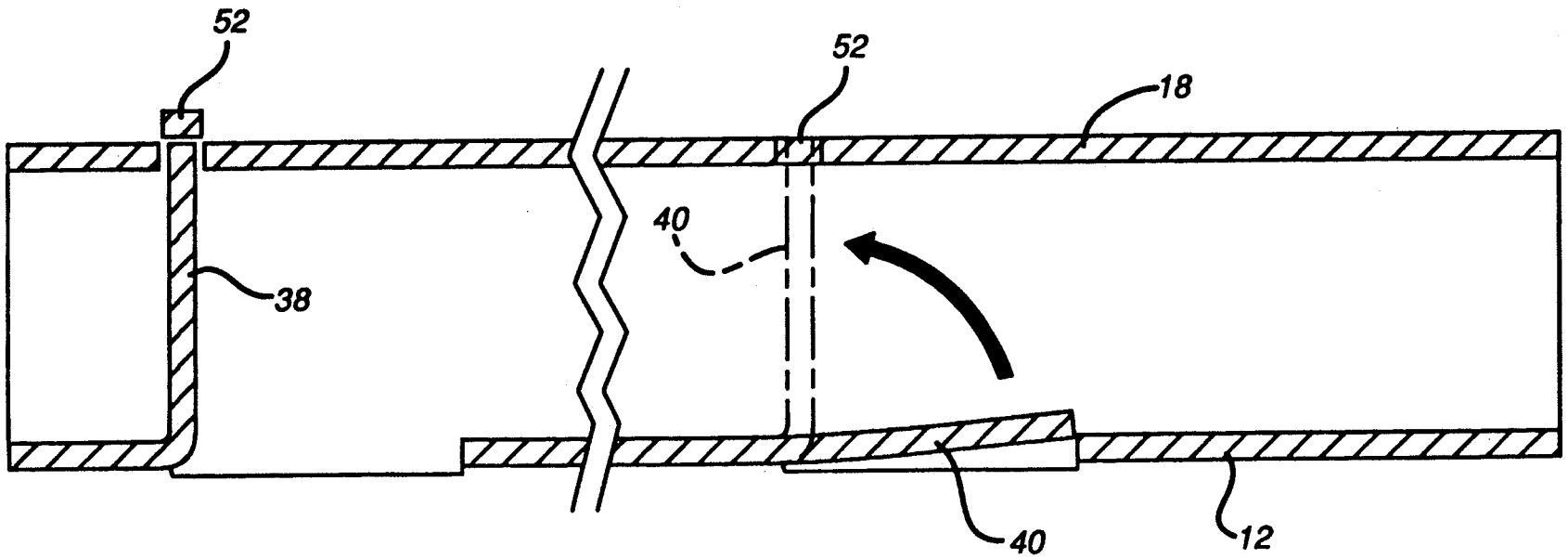
FIG. 6 is a fragmentary view taken along the line VI—VI in FIG. 5.

When the retaining flaps 38 and 40 are in the upright positions, the locking tabs 46 are received in the slots defined by the cut lines 50 in the top panel. This is shown in FIG. 6 wherein the strip 52 is displaced upwards due to the engagement of the locking tab 46 on the flap 38 with the associated slot. In like manner, the tab 46 on the other flap 40 is brought into engagement with the associated slot when the flap 40 is pivoted to the upright position shown by the dot and dash line in FIG. 6.

In addition, the assembled cushion can be folded flat again into a flat collapsed condition by unlocking the retaining flaps 38 and 40, by pivoting the flaps 38 and 40 back to the initial positions, and by lowering the side panels 14 and 16.

Having described the invention in detail and by reference to the preferred embodiment thereof, it will be apparent that modification and variation are possible without departing from the scope of the invention defined in the appended claims.

What is claimed is:

1. A cushioning member for placement into a shipping container, comprising:

a bottom panel;

a pair of spaced parallel side panels foldably joined to said bottom panel along first fold lines;

a top panel disposed in a spaced parallel relation to said bottom panel, said top panel including a pair of panel portions foldably joined respectively to said side panels along second fold lines, said panel portions overlapping each other and being secured together in a flat face contacting relation, said first and second fold lines being parallel to one another whereby said cushioning member may be collapsed along said first and second fold lines, one of said panel portions defining a free edge opposite said second fold line along which said one panel portion is joined to the adjacent one of said side panels;

retaining means for holding said cushioning member in a squared, set-up condition, said retaining means comprising a retaining flap struck from said bottom panel, said retaining flap being foldably joined to said bottom panel along a crease line and being folded into said cushioning member to extend between said side panels whereby said retaining flap holds said cushioning member in a set-up condition; and keel means substantially centrally disposed between said side panels and extending in a direction parallel to said first and second fold lines, said keel means comprising a center panel and a glue flap, said center panel being foldably joined to said free edge of said one panel portion and extending parallel to said side panels toward said bottom panel, said glue flap being foldably joined to said center panel along a fold line parallel to said first and second fold lines and being secured to said bottom panel.

2. A cushioning member for placement into a shipping container, comprising:

a bottom panel;

a pair of spaced parallel side panels foldably joined to said bottom panel along first fold lines;

a top panel disposed in a spaced parallel relation to said bottom panel, said top panel including inner and outer panel portions foldably joined respectively to said side panels along second fold lines, said inner and outer panel portions overlapping each other and being secured together in a flat face contacting relation wherein said inner panel portion underlies said outer panel portion, said first and second fold lines being parallel to one another whereby said cushioning member may be collapsed along said first and second fold lines;

retaining means for holding said cushioning member in a squared, set-up condition; and keel means disposed at a position between said side panels, said keel means comprising a center panel spaced from and parallel to said side panels and foldably joined to said inner panel portion, said center panel extending from said inner panel portion to a lower end, and a glue flap foldably joined to said lower end of said center panel along a third fold line and secured to said bottom penal, said third fold line being parallel to said first and second fold lines.

3. The cushioning member according to claim 2, wherein said retaining means comprises a retaining flap struck from said bottom panel, said retaining flap being foldably joined to said bottom panel along a crease line and being folded into said cushioning member to extend between said side panels whereby said retaining flap holds said cushioning member in a set-up condition.

4. The cushioning member according to claim 2, wherein said keel means is substantially centrally disposed between said side panels.

5. The cushioning member according to claim 2, wherein said inner panel portion defined a free edge opposite said second fold line along which said inner panel portion is joined to the adjacent one of said side panels, and said center panel is foldably joined to said free edge of said inner panel portion.

6. The cushioning member according to claim 3, wherein said keel means intersects said retaining flap, said keel means having at the intersection a cutout for permitting said retaining flap to pivot about said crease line.

7. The cushioning member according to claim 2, wherein said glue flap is secured to said bottom panel in a flat face contacting relation and extends from said third fold line toward one of said side panels to which said outer panels portion is joined along one of said second fold lines.

8. The cushioning member according to claim 3, wherein said top panel has locking means separably engaged with said retaining flap to releasably lock said retaining flap in a folded position.

9. The cushioning member according to claim 8, wherein said retaining flap defines a free edge opposite said crease line and includes a locking tab disposed at said free edge, and said locking means is a slot formed in said top panel, said slot receiving and engaging said locking tab so that said retaining flap extends between said top and bottom panels.

10. The cushioning member according to claim 1, wherein said keel means intersects said retaining flap, said keel means having at the intersection a cutout for permitting said retaining flap to pivot about said crease line.

11. The cushioning member according to claim 2, wherein said top panel has at least one opening for receiving a portion of an article to be packed in a shipping container together with said cushioning member.

* * * * *